US011878207B2

(12) United States Patent
Montesalvo et al.

(10) Patent No.: US 11,878,207 B2
(45) Date of Patent: Jan. 23, 2024

(54) FITNESS EQUIPMENT

(71) Applicant: Blindside Group Pty Ltd, Molendinar (AU)

(72) Inventors: James Albert Montesalvo, Molendinar (AU); Christian Purnell, Pacific Pines (AU)

(73) Assignee: Blindside Group Pty Ltd, Molendinar (AU)

( * ) Notice: Subject to any disclaimer, the term of this patent is extended or adjusted under 35 U.S.C. 154(b) by 0 days.

(21) Appl. No.: 17/093,235

(22) Filed: Nov. 9, 2020

(65) Prior Publication Data

US 2021/0138295 A1 May 13, 2021

(30) Foreign Application Priority Data

Nov. 11, 2019 (AU) ..... 2019904241

(51) Int. Cl.
*A63B 21/00* (2006.01)
*A63B 23/12* (2006.01)
*A63B 22/00* (2006.01)

(52) U.S. Cl.
CPC ..... *A63B 21/4029* (2015.10); *A63B 22/0076* (2013.01); *A63B 23/1209* (2013.01); *A63B 2210/50* (2013.01)

(58) Field of Classification Search
CPC ..... A63B 21/4029; A63B 22/0076; A63B 23/1209; A63B 2210/50; A63B 2210/02; A63B 21/4027–4031; A63B 9/00; A63B 2009/004; A63B 17/00–04; A63B 21/00047–0054; A63B 21/078; A63B 21/4037–4039; A63B 21/4045–4049; A63B 22/0087–0089; A63B 22/14; A63B 22/16–18; A63B 22/20–208; A47C 11/00–005; A47C 13/00–005; A47B 83/02; A47B 2220/01; A47B 83/001; A47B 2001/053; A47B 3/08–0803; A47B 2003/0835; A47B 3/12; A47B 5/006; A47B 11/00; A47B 9/18; A47B 17/03; A47B 17/036; A47B 17/065; A47B 2023/047; A47B 23/00–06
See application file for complete search history.

(56) References Cited

U.S. PATENT DOCUMENTS 2,348,573 A * 5/1944 Yubie ..... A47C 13/00 297/142
4,634,127 A * 1/1987 Rockwell ..... A63B 21/0628 297/118
4,765,616 A * 8/1988 Wolff ..... A63B 21/078 482/104

(Continued)

*Primary Examiner* — Joshua Lee
*Assistant Examiner* — Catrina A Letterman
(74) *Attorney, Agent, or Firm* — Dorsey & Whitney LLP

(57) ABSTRACT

The present invention generally relates to seated fitness equipment. The fitness equipment includes a first seat and a retractable second seat. The retractable second seat is suitable for retracting from an extended position to a retracted position so that the seats are at least partially superposed. Advantageously, the superposed seats may occupy less floorspace (yielding more usable floorspace) thereby making the seated fitness equipment suitable to cramped gymnasiums. Preferably, the seats are substantially superposed, with one seat directly above the other.

19 Claims, 3 Drawing Sheets

(56) References Cited

U.S. PATENT DOCUMENTS

| | | | | | |
|---|---|---|---|---|---|
| 5,921,897 | A * | 7/1999 | Stevens | A63B 21/078 | 482/104 |
| 5,927,835 | A * | 7/1999 | Mergold | A47B 83/045 | 297/142 |
| 6,264,586 | B1 * | 7/2001 | Webber | A63B 23/00 | 482/104 |
| 6,287,243 | B1 * | 9/2001 | Isom | A63B 21/078 | 482/104 |
| 6,371,896 | B1 * | 4/2002 | Kettler | A63B 21/4029 | 297/14 |
| 2005/0148449 | A1 * | 7/2005 | Weir | A63B 21/078 | 482/142 |
| 2006/0284529 | A1 * | 12/2006 | Milutinovics | A47B 9/10 | 312/319.8 |
| 2007/0169673 | A1 * | 7/2007 | Tseng | A47B 1/04 | 108/65 |
| 2008/0076641 | A1 * | 3/2008 | Sheehan | A63B 21/0552 | 482/92 |
| 2009/0143203 | A1 * | 6/2009 | Knapp | A63B 21/078 | 482/104 |
| 2013/0217546 | A1 * | 8/2013 | Heideman | A63B 21/4047 | 482/92 |
| 2014/0243174 | A1 * | 8/2014 | Alenaddaf | A63B 17/00 | 482/142 |
| 2015/0202484 | A1 * | 7/2015 | Lalaoua | A63B 23/0211 | 482/130 |
| 2016/0199687 | A1 * | 7/2016 | Ho | A63B 23/0205 | 482/66 |
| 2017/0304676 | A1 * | 10/2017 | Lalaoua | A63B 21/00069 | |
| 2018/0369633 | A1 * | 12/2018 | Baker | A63B 23/00 | |

* cited by examiner

FITNESS EQUIPMENT

TECHNICAL FIELD

The present invention relates to fitness equipment.

The present invention has particular, although not exclusive application to seated fitness equipment used in gymnasiums.

BACKGROUND

The reference to any prior art in this specification is not, and should not be taken as an acknowledgement or any form of suggestion that the prior art forms part of the common general knowledge.

Seated fitness equipment is known.

A cable row machine includes a seat. The seat is typically fixed in place. In practice, the seat can be a tripping hazard due to the long length of the seat, particularly in cramped gymnasiums. A known flat bench can pivot to form a seat with an inclined backrest. However, the backrest invariably occupies space which is often at a premium, particularly in cramped gymnasiums.

The preferred embodiment provides seated fitness equipment suited to cramped gymnasiums.

SUMMARY OF THE INVENTION

According to one aspect of the present invention, there is provided fitness equipment including:

a first person support; and a retractable second person support for retracting from an extended position to a retracted position so that the person supports are at least partially superposed.

In one embodiment, the supports are seats. In one embodiment, the supports are separated. In another embodiment, the supports are integrally formed.

According to another aspect of the present invention, there is provided seated fitness equipment including:

a first seat; and a retractable second seat for retracting from an extended position to a retracted position so that the seats are at least partially superposed Advantageously, the superposed seats may occupy less floorspace (yielding more usable floorspace) thereby making the seated fitness equipment suitable to cramped gymnasiums. Preferably, the seats are substantially superposed, with one seat directly above the other.

Preferably, the second seat can be used as a seat in both the extended and retracted positions to facilitate use for different exercises. The second seat may extend in line with the first seat in the extended position, and be stacked with or overlay the first seat in the retracted position. The first and second seats may be substantially flush when the second seat is in an extended position. Each seat may be elongate and form a flat bench when the second seat is in the extended position to facilitate lying down. The second seat may rotate when moving from the extended position to the retracted position. The second seat may be elevated when moving from the extended position to the retracted position. The elevation movement may be gradual.

The second seat may include a support at its free end for supporting the second seat in the retracted position. The support may include a stopper for stopping against a frame of the fitness equipment.

The fitness equipment may further include an upright support for supporting both seats. The upright may define a tracking surface upon which the second seat tracks when moving. The cam surface may terminate in a cradle at its bottommost point for cradling the second seat in an extended position. The upright may include an outer tube defining the surface. The second seat may include a roller for rolling along the tracking surface.

The fitness equipment may further include a retainer for retaining the outer seat in the fitness equipment.

Preferably, the seats are separate parts. The fitness equipment may be a rowing or lat pulldown machine, or a bench, or any other fitness equipment.

According to another aspect of the present invention, there is provided seated fitness equipment including:

a first seat; and a movable second seat for moving relative to the first seat so that the seats at least partially coincide to occupy less floor space.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
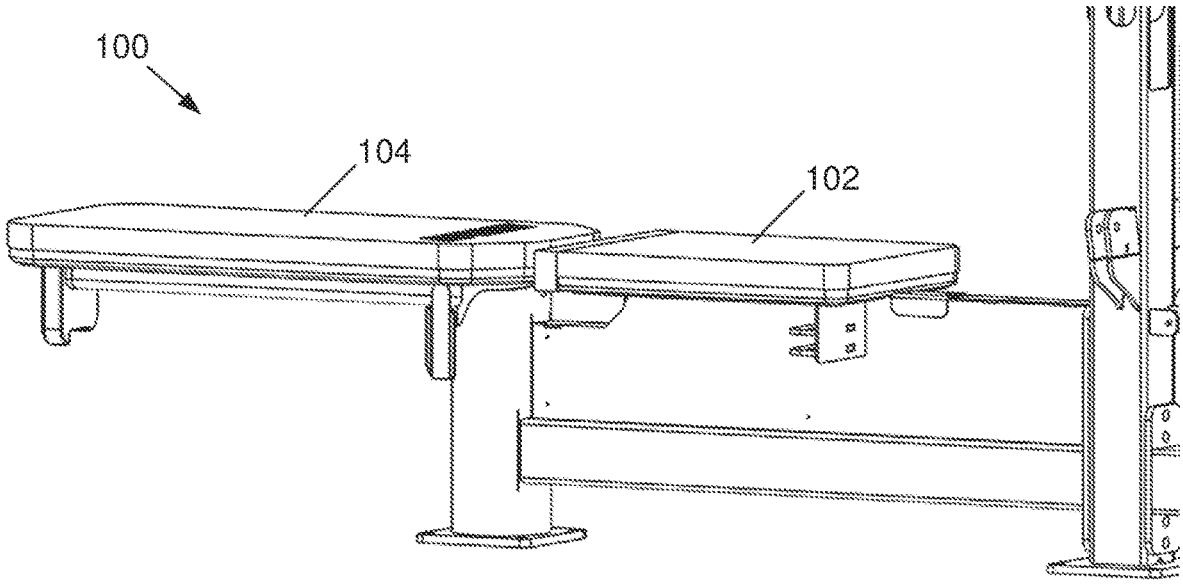
FIG. 1 is a side perspective view of seated fitness equipment in accordance with an embodiment of the present invention, with the outer seat in a extended position.
Figure 2:
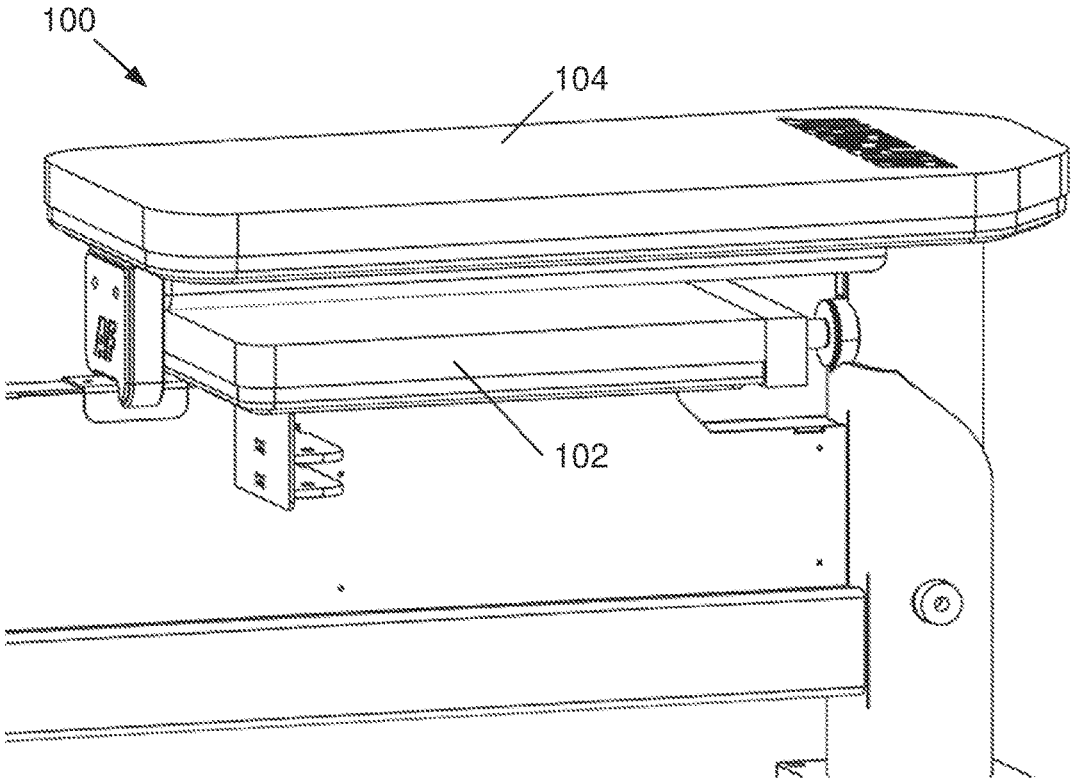
FIG. 2 is a close-up reverse side perspective view of the seated fitness equipment of FIG. 1, with the outer seat in a retracted position.

According to an embodiment of the present invention, there is provided seated fitness equipment 100 as shown in FIGS. 1 and 2. The seated fitness equipment 100 includes a fixed inner (i.e. first) seat 102 and a retractable outer (i.e. second) seat 104. The outer seat 104 retracts from an extended position shown in FIG. 1 to superpose with the inner seat 102 in a retracted position as shown in FIG. 2.

Advantageously, the stacked and superposed seats 102, 104 compact the gym floorspace occupied by both seats 102, 104 in the retracted position thereby making the seated fitness equipment 100 highly suitable to cramped gymnasiums. The outer seat 104 maintains an upright disposition during reconfiguration, and can be used as a seat in both the extended and retracted positions to facilitate use for different exercises.

As can best be seen in FIG. 1, the aligned inner and outer seats 102, 104 are substantially flush when the outer seat 104 is in an extended position. In this manner, the elongate seat 102, 104 forms a flat bench to facilitate lying down.

Figure 3:
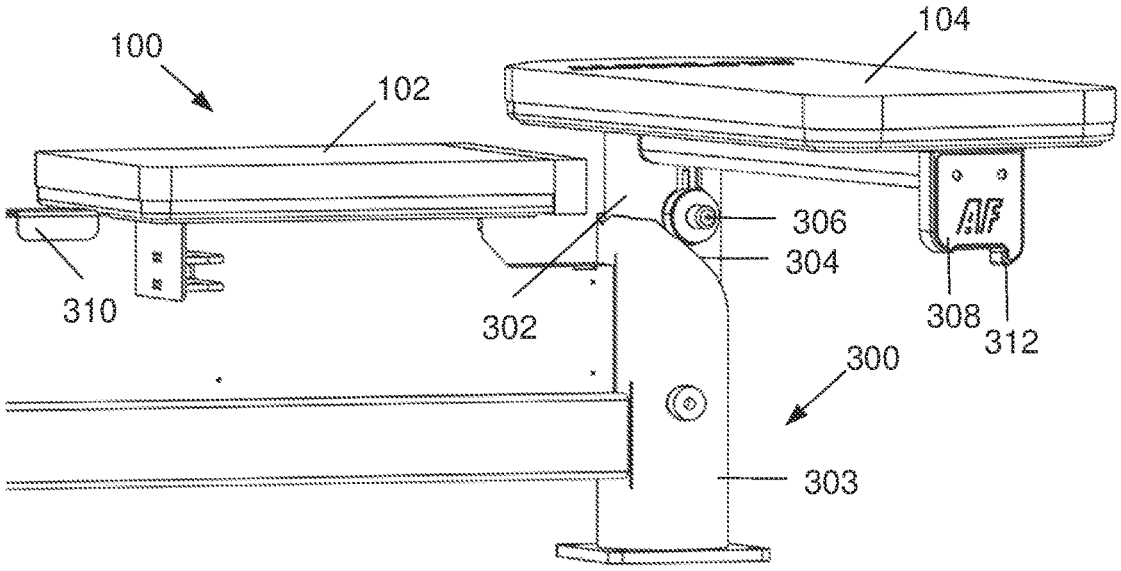
FIG. 3 is a side perspective view of the seated fitness equipment of FIG. 1 transitioning from the extended position.

Turning to FIG. 3, the fitness equipment 100 further includes an upright support 300 for supporting adjacent ends of both seats 102, 104 as the outer seat 104 rotates about the upright support 300 when moving from the extended position to the retracted position. The outer seat 104 includes an inner tube 302 which rotates within an outer tube 303 of the tubular upright support 300.

The outer tube 303 of the support 300 defines a tracking cam edge surface 304 upon which the outer seat 104 tracks when moving. In particular, the outer seat 104 also includes a roller 306, fitted to the inner tube 302, that rolls along the tracking surface 304.

The outer seat 104 is elevated gradually along the tracking surface 304 when moving from the extended position to the retracted position. The outer seat 104 also includes a support 308 at its free end for engaging, using a bight on its underside, with the fitness equipment frame 310 and supporting the stacked outer seat 104. The support 308 includes a protruding stopper 312 for stopping hard against the frame 310 to prevent over-rotation.

Figure 4:
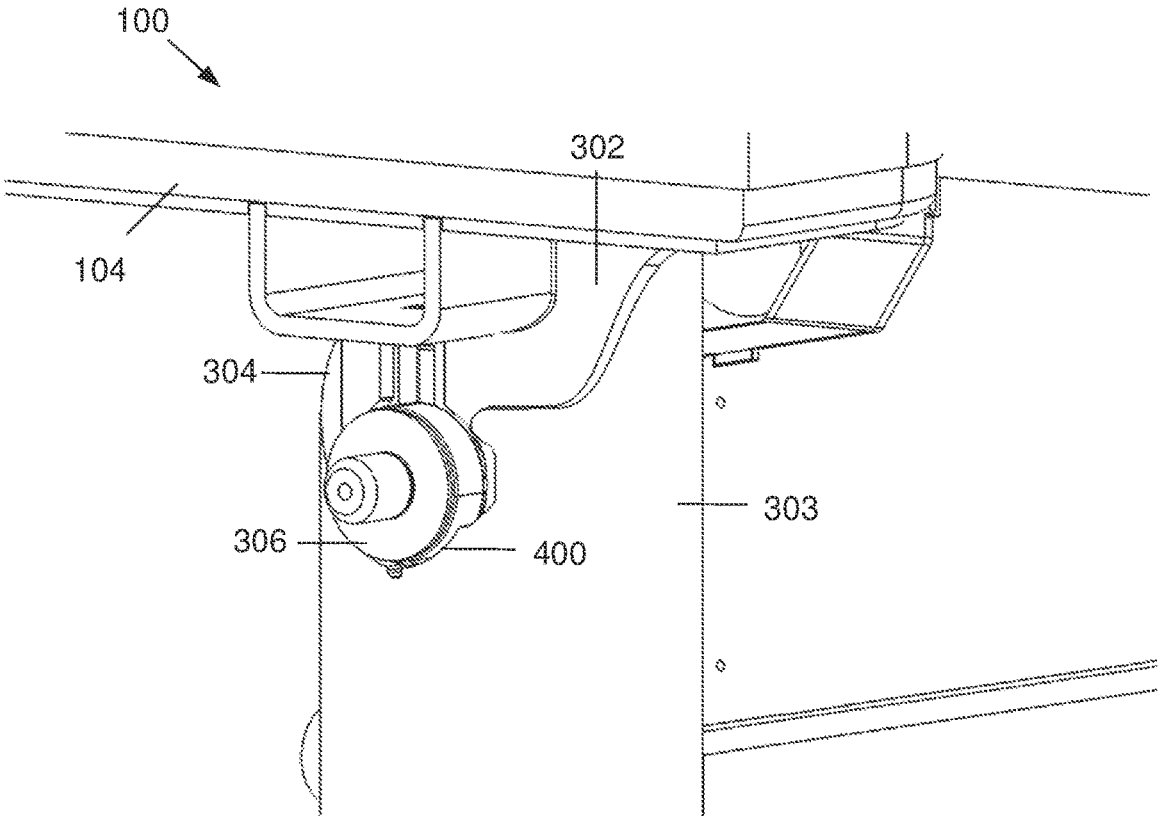
FIG. 4 is a close-up side perspective view showing a tracking roller of the outer seat.

Turning to FIG. 4, the cam surface 304 terminates in a cradle 400 or retainer at its bottommost point for cradling the roller 306 of the outer seat 104 in the extended position. A similar cradle terminates the topmost point of the cam surface 304 in the retracted position.

Figure 5:
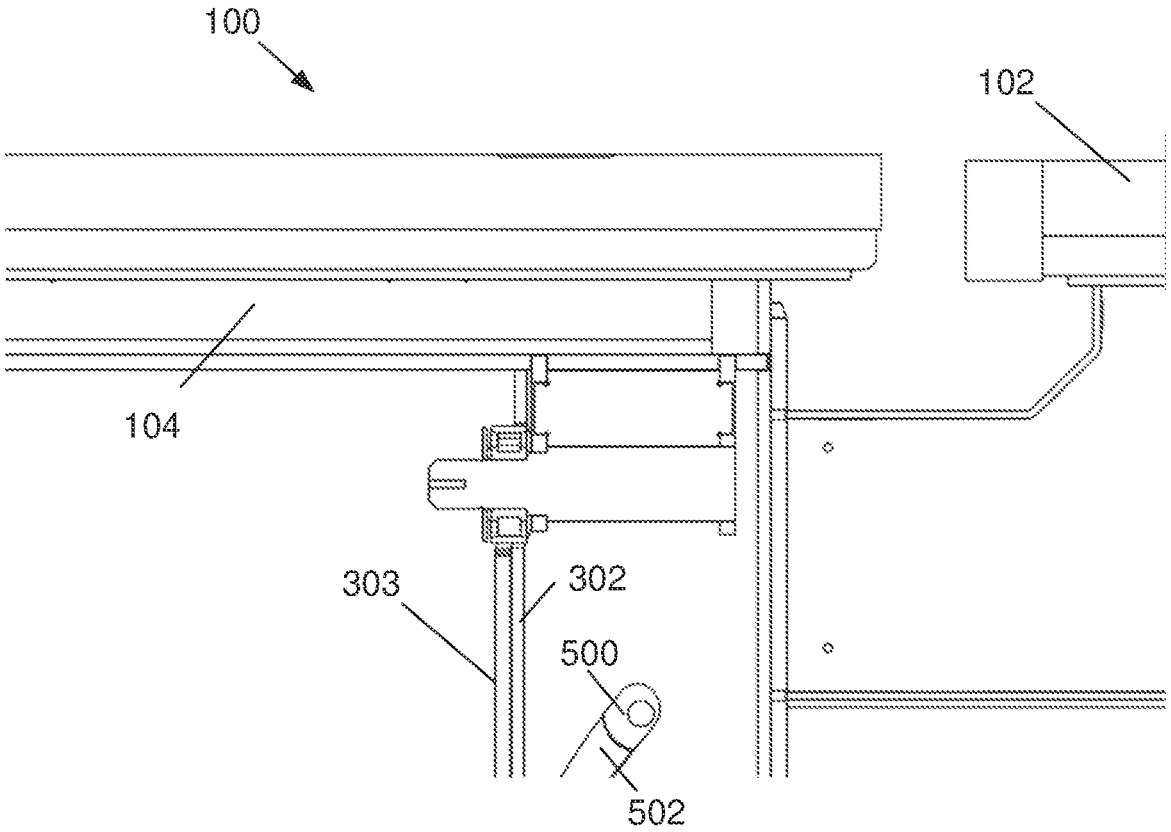
FIG. 5 is a close-up sectional side view of the seated fitness equipment.

As previously described, roller 306 rolls on a cut profile face 304 of outer tube 303. As shown in FIG. 5, an internal cavity 502 exists in inner tube 302 of outer seat 104. A pin 500 is used to prevent removal of outer seat 104 from outer tube 303, whilst facilitating desirable movement by virtue of the internal cavity 502. The foregoing retainer retains the outer seat 104 in the fitness equipment 100.

In practice, the free end of the outer seat 104 in the extended position is rotated so that the roller 306 tracks up the cam surface 304. The outer seat 104 then stops when stacked above the inner seat 102 in the retracted position. Application of weight to the equipment 100 increases the centralizing force, such that the stacked seats 102, 104 become rigid and resistant to motion when in use, as the underside bight of the support 308 receives the equipment frame 310 and the roller 306 is cradled in the topmost cradle. When the user gets off the outer seat 104, the seat 104 can be counter-rotated to be extended once again.

A person skilled in the art will appreciate that many embodiments and variations can be made without departing from the ambit of the present invention.

The seated fitness equipment 100 can be a seated row or lat pulldown machine, or a bench. However, the equipment can also take many other forms so that the overall geometry and floorspace required can be reduced in one configuration (exercise), but then increased for another configuration (exercise) as required. Longer supports facilitate a greater range of exercises. The fitness equipment 100 could be any piece of fitness equipment that requires a support, platform, bench or seat.

In one embodiment, the roller 306 may be replaced by a pin or bearing.

The cradle 400 terminating either end of the tracking surface 304 can be replaced by any mechanism to prevent or resist movement past a desired point, such as hard limits, pins or stops.

In one embodiment, the roller 306 and tracking surface 304 arrangement can be replaced by a flip or folding top seat with hinge arrangement, a slider arrangement or a parallel linkage.

In one embodiment, the outer seat 104 retracts beneath the inner seat 102.

In one embodiment, the seats 102, 104 are integrally formed. Accordingly, they are made from 1 or more pads. A single pad could have an internal hinge to facilitate extension (flipping) whilst looking like a singular body due to the covering being a single continuous fabric or foam.

In compliance with the statute, the invention has been described in language more or less specific to structural or methodical features. It is to be understood that the invention is not limited to specific features shown or described since the means herein described comprises preferred forms of putting the invention into effect.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. A fitness equipment, comprising:

a first person-support;

a retractable second person-support retractable from an extended position to a retracted position so that the first person-support and the retractable second person-support are at least partially superposed;

wherein the first person-support is substantially parallel to a surface on which the fitness equipment is disposed and the retractable second person-support remains horizontal when moving from the extended position to the retracted position, pivoting about an axis substantially perpendicular to the surface on which the fitness equipment is disposed; and an upright support for supporting both of the first person-support and the second person-support, the upright support defining an inclined tracking surface in an outer side surface thereof and upon which the second person-support tracks when moving, wherein the retractable second person-support rotates about the upright support when moving from the extended position to the retracted position.

2. The fitness equipment of claim 1, wherein:

the first person-support includes a first seat and the retractable second person-support includes a second retractable seat; and wherein the upright support supports adjacent ends of the first seat and the second retractable seat.

3. The fitness equipment of claim 1, wherein the first person-support and the retractable second person-support are separated or integrally formed.

4. A fitness equipment, comprising:

a first seat;

a retractable second seat retractable from an extended position to a retracted position so that the first seat and the retractable second seat are at least partially superposed;

wherein the first seat is substantially parallel to a surface on which the fitness equipment is disposed and the retractable second seat remains horizontal when moving from the extended position to the retracted position, pivoting about an axis substantially perpendicular to the surface on which the fitness equipment is disposed;

an upright support for supporting both of the first and second seats, the upright support defining an inclined tracking surface in an outer side surface thereof and upon which the second seat tracks when moving, wherein the retractable second seat rotates about the upright support when moving from the extended position to the retracted position.

5. The fitness equipment of claim 4, wherein the superposed first and retractable second seats occupy less floorspace, yielding more usable floorspace.

6. The fitness equipment of claim 4, wherein the first seat and the retractable second seat are horizontal and superposed in the retracted position, with one of the first seat and the retractable second seat directly above the other.

7. The fitness equipment of claim 4, wherein:

in the extended position, the first seat extends horizontally from the retractable second seat to form an elongated horizontal seat that includes both the first seat and the retractable second seat; and in the retracted position, the first seat is vertically stacked adjacent to the retractable second seat such that the retractable second seat is configured to be used as a seat in both the extended and retracted positions to facilitate use for different exercises.

8. The fitness equipment of claim 4, wherein the retractable second seat extends in line with the first seat in the extended position, and is stacked with or overlays the first seat in the retracted position.

9. The fitness equipment of claim 4, wherein the first seat and the retractable second seat are flush when the retractable second seat is in an extended position.

10. The fitness equipment of claim 4, wherein each of the first seat an the retractable second seat is elongate and forms a flat bench when the retractable second seat is in the extended position to facilitate lying down.

11. The fitness equipment of claim 4, wherein the retractable second seat rotates and remains horizontal when moving from the extended position to the retracted position.

12. The fitness equipment of claim 4, wherein the retractable second seat is elevated when moving from the extended position to the retracted position, the elevation movement being gradual.

13. The fitness equipment of claim 4, wherein the retractable second seat includes a support at its free end for supporting the retractable second seat in the retracted position.

14. The fitness equipment of claim 4, wherein the inclined tracking surface terminates in a cradle at its bottommost point for cradling the retractable second seat in an extended position.

15. The fitness equipment of claim 4, wherein the upright support includes an outer tube defining the inclined tracking surface, the retractable second seat including a roller configured to roll along the inclined tracking surface or a tracker for tracking the inclined tracking surface.

16. The fitness equipment of claim 4, further comprising a retainer for retaining the retractable second seat in the fitness equipment.

17. The fitness equipment of claim 4, wherein the first seat and the retractable second seat are separate parts.

18. The fitness equipment of claim 4, and in the form of a rowing or lat pulldown machine, or a bench, or any other like seated fitness equipment.

19. A fitness equipment, comprising:

a first seat;

a movable second seat movable relative to the first seat so that the first seat and the movable second seat at least partially coincide to occupy less floor space;

wherein the movable second seat remains horizontal when moving from an extended position to a retracted position, pivoting about an axis substantially perpendicular to a surface on which the fitness equipment is disposed, wherein the movable second seat is usable in both the extended and retracted positions; and an upright support for supporting both of the first seat and the moveable second seat, the upright support defining an inclined tracking surface in an outer side surface thereof and upon which the moveable second seat tracks when moving, wherein the moveable second seat rotates about the upright support when moving from the extended position to the retracted position.

* * * * *